United States Patent [19]

Chan

[11] Patent Number: 4,716,505

[45] Date of Patent: Dec. 29, 1987

[54] TABLE LAMPS

[75] Inventor: Shui L. D. Chan, Kowloon, Hong Kong

[73] Assignee: New Horizons Product Development Company Limited, Hong Kong

[21] Appl. No.: 14,632

[22] Filed: Feb. 13, 1987

[51] Int. Cl.[4] ..... F21S 1/02

[52] U.S. Cl. ..... 362/287; 362/427; 362/418

[58] Field of Search ..... 362/418, 419, 422, 427, 362/801, 217, 220, 287

[56] References Cited

U.S. PATENT DOCUMENTS

| | | | |
|---|---|---|---|
| 2,466,722 | 4/1949 | May | 362/419 |
| 2,740,039 | 3/1956 | Phillips | 362/427 |
| 3,012,801 | 12/1961 | Cole | 362/418 |
| 3,601,598 | 8/1971 | Horn | 362/418 |
| 4,238,816 | 12/1980 | Merlo | 362/306 |
| 4,242,726 | 12/1980 | Steadman | 362/418 |
| 4,494,177 | 1/1985 | Matthews | 362/418 |
| 4,525,773 | 6/1985 | Hesse et al. | 362/427 |

*Primary Examiner*—Craig R. Feinberg
*Assistant Examiner*—David A. Okonsky
*Attorney, Agent, or Firm*—Warren B. Kice

[57] ABSTRACT

A table lamp comprising a base, an arm upstanding from the base, an illuminating bulb positioned at the upper end of the arm to provide illumination, the arm further comprising a plurality of substantially similar segments, means for rotatably joining adjacent segments to one another and commutator means between adjacent segments for transferring electrical power for the lamp from one segment to the adjacent segment, and means within each segment for connecting one commutator means to an adjacent commutator means to provide continuity of current to the lamp.

9 Claims, 5 Drawing Figures

TABLE LAMPS

This invention relates to table lamps and in particular a lamp which is capable of taking up one of a number of different configurations.

BACKGROUND TO THE INVENTION

Whilst a wide range of table lamps are known, those which have an adjustment to enable the position of the light bulb to be varied to suit the user tend to be of the type where a pair of arms are hinged to one another. Thus, by hinging these arms relative one another and a suitable base, the light can be positioned as required by a user to give the desired illumination.

It is an object to the present invention to provide a table lamp where its adjustment is made in a different way by swivelling a number of parts of the support relative one another.

BRIEF SUMMARY OF THE INVENTION

According to the invention, there is provided a table lamp comprising a base, an arm upstanding from the base, an illuminating bulb positioned at the upper end of the arm to provide illumination, the arm further comprising a plurality of substantially similar segments, means for rotatably joining adjacent segments to one another, commutator means between adjacent segments for transferring electrical power for the lamp from one segment to the adjacent segment, and means within each segment for connecting one commutator means to an adjacent commutator means to provide continuity of current to the lamp.

With such a table lamp, the various segments can be twisted relative one another totally independently and so a very precise positioning of the lamp relative the base can be achieved. Also, the lamp can be arranged to take a large number of interesting and attractive shapes.

According to one further embodiment of the invention, each segment is in the form of a pyramid with a square base and adjacent segments abut one another along upright sides of the pyramid. The pyramid-shaped segment can, for example, have a pointed apex, or alternatively, a width-wise extending peak which, when aligned with the rectangular-shaped base, will provide an arm which is effectively straight and inclined to the base of the lamp.

In a preferred embodiment, each segment is in the form of a pyramid with a rectangular-shaped base and a width-wise extending apex having a width corresponding to the width of the rectangular base and having sides in the form of equilateral triangles, each inclined side, however, being in the form of a square whose sides equal the width of the rectangular base.

In order to provide the lamp with a form of positive alignment, it is preferred that detent means be provided between adjacent segments for resiliently holding one segment relative its neighbour at various preferred orientations. Such an orientation can, for example, be aligned with the sides of the base of each segment.

The commutator means are preferably combined with the bearing means and a simple and convenient form of commutator means comprises concentric conductive rings for each segment which are resiliently engaged with one another in face-to-face contact so as to provide excellent electrical contact between the respective rings irrespective of the angle of rotation of the adjacent segments relative one another.

BRIEF DESCRIPTION OF THE DRAWINGS

An example of the table lamp according to the invention will now be described with reference to the accompanying drawings, in which.

DESCRIPTION OF THE PREFERRED EMBODIMENT

Figure 1:
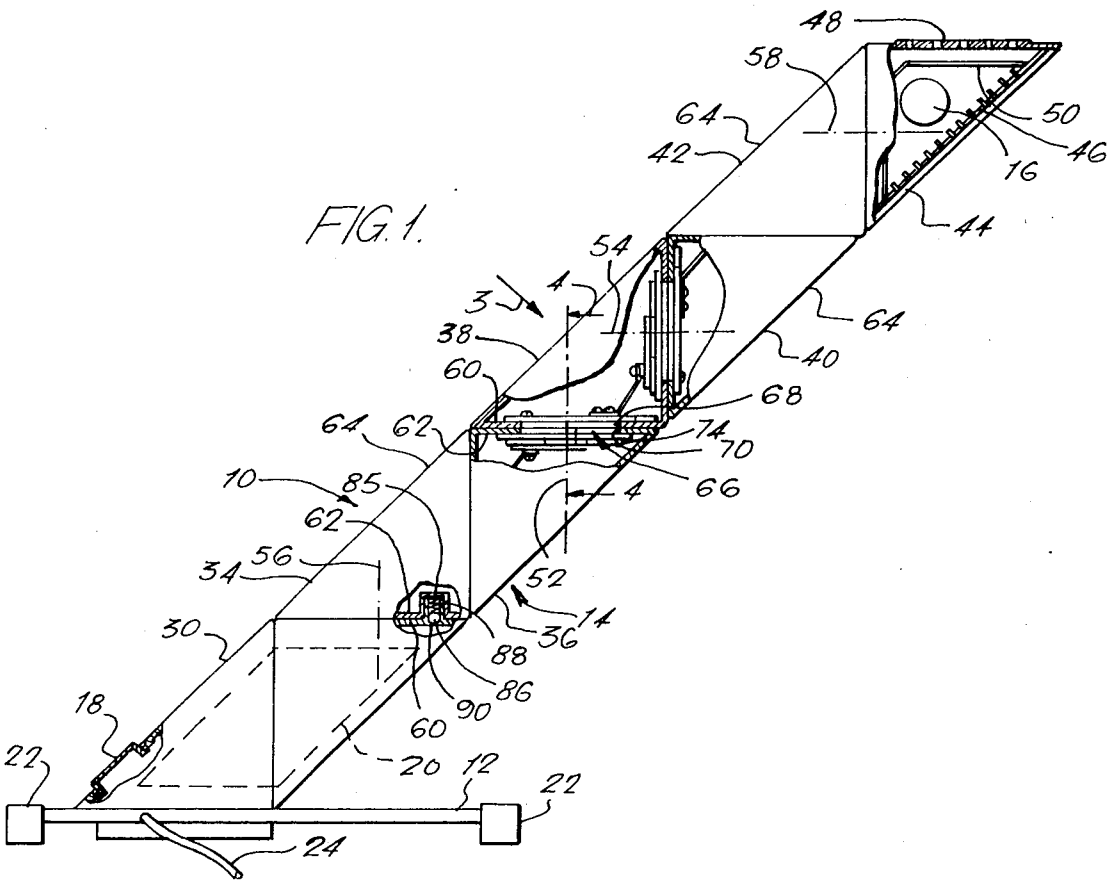
FIG. 1 is a side elevational view of the lamp with parts broken away to show interior details.

The table lamp 10 shown in the drawings comprises a base 12 from which extends an arm 14 at an angle of 45° to the upright. At the top end of the arm is provided a light bulb 16 for illumination. At the lower end of the arm and adjacent the base 12 is provided an on-off switch 18 and within the lower end of the arm is provided a transformer 20 (not shown in detail) to convert the mains supply to a low voltage suitable for a low voltage, high intensity bulb 16. This has the advantage of safety in that the power supplied to the bulb along the arm 14 can then be of a relatively low voltage but high current. The base is provided with four feet 22 at its corners. Additionally, an input supply lead 24 with a conventional plug are attached the base 12 but are not shown in detail since they are entirely conventional.

The arm 14 is composed of a number of segments 30 to 44. The two lower segments 30 and 32 are in fact integrally formed as one unit and contain the transformer 20 and the switch 18. These two lower segments 30 and 32 are attached to the base 12.

The uppermost segment 44 contains the light bulb 16 and is provided with an outlet grill 46 and its upper surface has an air grill or vent 48 to provide cooling. Within it is positioned a reflector 50 to ensure that a major amount of the light is usefully reflected out through the grill 46.

The remaining segments 34 to 40 are positioned between the segments 30, 32 and 44 and are mounted so that each adjacent segment is capable of being swivelled through 360° relative its neighbour but independently of any other segment. By way of example and referring to FIG. 1, the segments 36 and 38 can be swivelled relative one another about an upright axis 52 whilst that segment 38 and the adjacent segment 40 can be swivelled relative one another about a horizontal axis 54. The same is true for each adjacent pair of segments along the arm, except of course that the segments 30 and 32 are integrally formed as one. However, at the lower end, the segment 34 can swivel about an upright axis 56 relative the segment 32, and at the upper end, the segment 44 containing the bulb 16 is capable of being swivelled through 360° about a horizontal axis 58 relative the segment 42.

Figure 3:
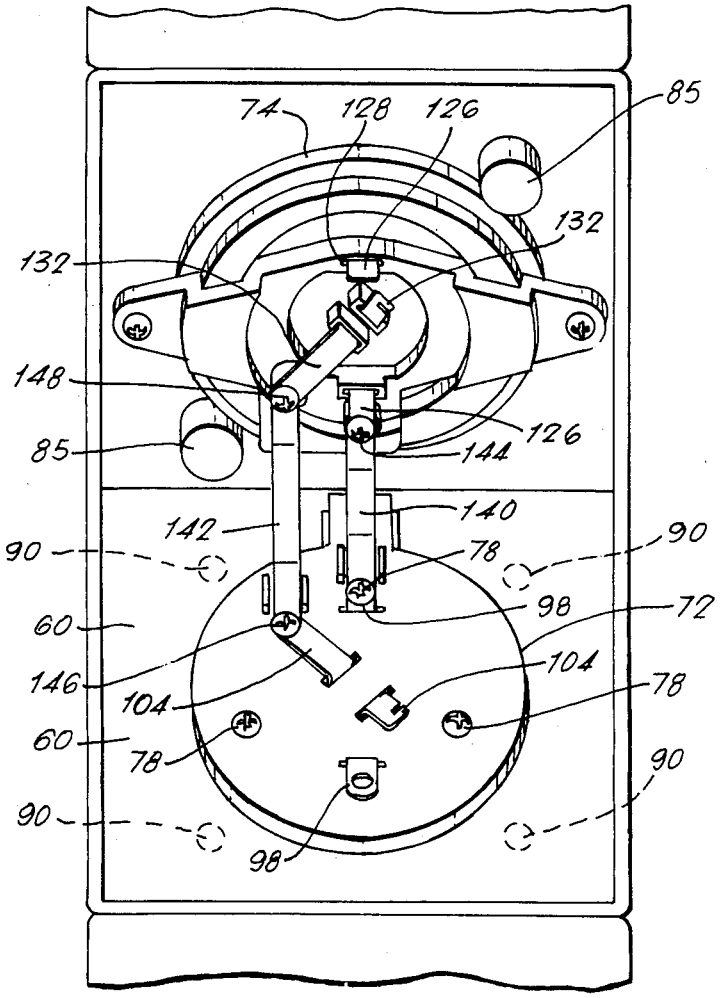
FIG. 3 is a perspective detail view taken in the direction of the arrow 3 of FIG. 1.

Apart from the segments 30 and 32, each segment 34 to 44 is, as seen from the side in FIG. 1, of isosceles triangular shape. Referring to FIG. 3, each of the faces 60 and 62 (FIG. 3) where two segments abut is of square shape and a face 64 which is the base of the isosceles triangle is of rectangular shape.

In addition, in the particular example shown, the isosceles triangle is a right angle triangle with the right angle at the apex and the two equal angles are of 45°. This means that the arm 14 effectively slopes at 45° to the upright.

Figure 5:
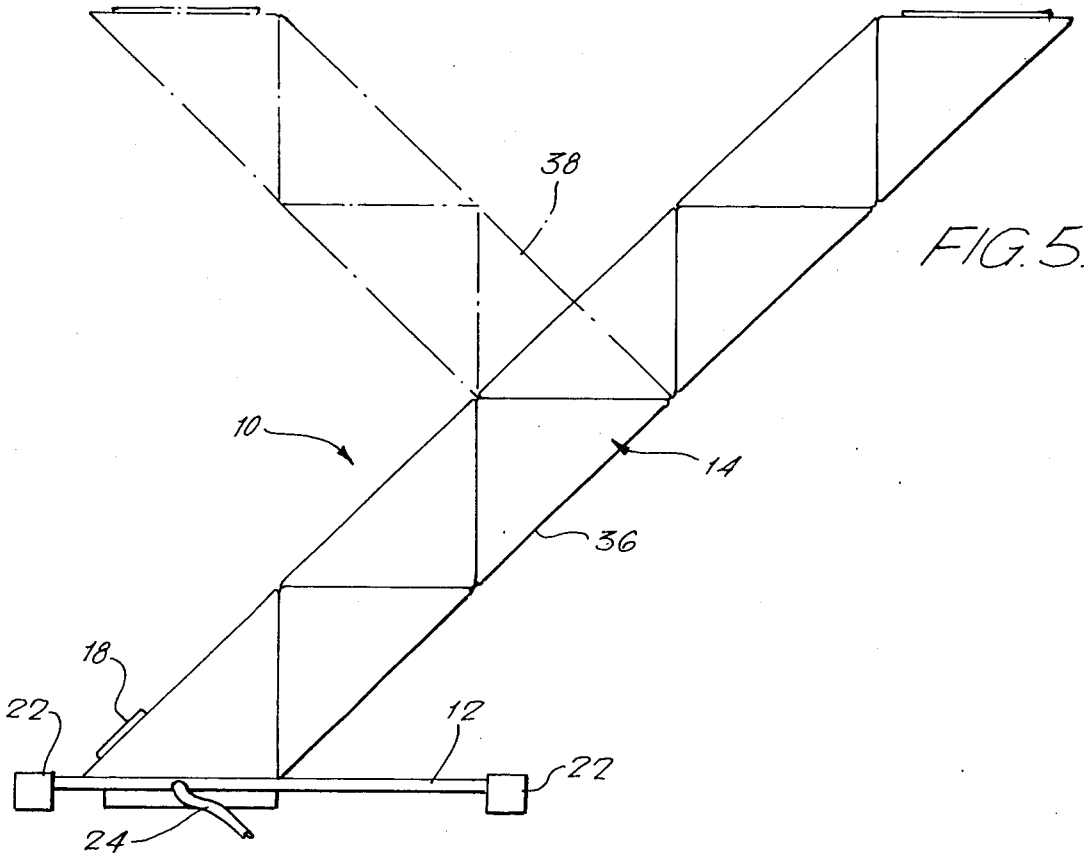
FIG. 5 is a diagram of a side elevational view similar to FIG. 1 but showing the lamp in an alternative configuration.

As a result of the swivelling of adjacent segments relative one another, the arm 14 can be given a very wide range of shapes. FIG. 5 shows one simple example where the segments 36 and 38 have been swivelled relative one another at an angle of 180° relative what is shown in FIG. 1. Each of the segments 34 and 44 could, however, be swivelled to different angles such as 90° relative one another from what is shown in FIG. 1 to give a very large number of variations in the shape of the arm and, accordingly, in the positioning of the lamp 16 relative the user of the light. Thus, the user can adjust the position of the arm and the eventual position and direction of illumination to the best level and direction.

Adjacent segments 32 to 44 are held together with faces 60 and 62 abutting by means of a composite bush 66. This passes through holes 68 and 70 (FIG. 2) formed in the faces 60 and 62, respectively.

The composite bush 66 is formed of a circular plate portion 72 having a circular flange 73 spaced inwardly from its outer edge and an annular portion 74 having a corresponding circular flange 76 spaced inwardly of the outer edge of the portion 74 and of identical diameter to the flange 73. These two flanges abut one another in the composite bush 66. The two portions 72 and 74 are held together by three screws 78 which pass through the portion 72 and are screwed into upright pillars 80 integrally formed in the portion 74.

The outer diameter of the flanges 73 and 76 are slightly less than the diameter of the holes 68 and 70. Therefore, when the bush 66 is assembled, the flanges 73 and 76 pass through the holes 68 and 70 but the parts of the portions 72 and 74 outwardly of the flanges 73 and 76 engage, grip and hold the two faces 60 and 62 into mating engagement. The two faces and therefore the segments can, however, rotate throughout 360° relative one another.

Extending radially outwardly from the portion 72 is an integral lug 82. This is engaged between a pair of integral upright ribs 84 on the inside of the face 60. This ensures that the composite bush 66 is held stationary relative the face 60 but the bush can and does rotate freely relative the face 62.

Although the composite bush 66 allows adjacent pairs of segments to rotate through 360°, it is desirable to provide the adjacent segments with a number of preferred resiliently fixed orientations. As best shown in FIG. 1, integrally formed in each face 62 are a pair of hollow cylindrical housings 85 diametrically spaced relative the hole 70. Each housing contains a ball 86 loaded against the face 60 by a coil spring 88. In that face 60 are, as best shown in FIG. 3, provided four small annular recesses 90, spaced at 90° around the hole 68. Therefore, preferentially the adjacent segments can be aligned in straight orientation as shown in FIG. 1, or an orientation where a mating pair of segments can be rotated through 180° as is shown in FIG. 5. Further, the other pair of recesses 90 can be engaged when an adjacent pair of segments are rotated through only 90° or 270° relative the position shown in FIG. 1 so that the arm can then extend outwardly side to side rather than fore and aft as shown in FIGS. 1 and 5.

Figure 4:
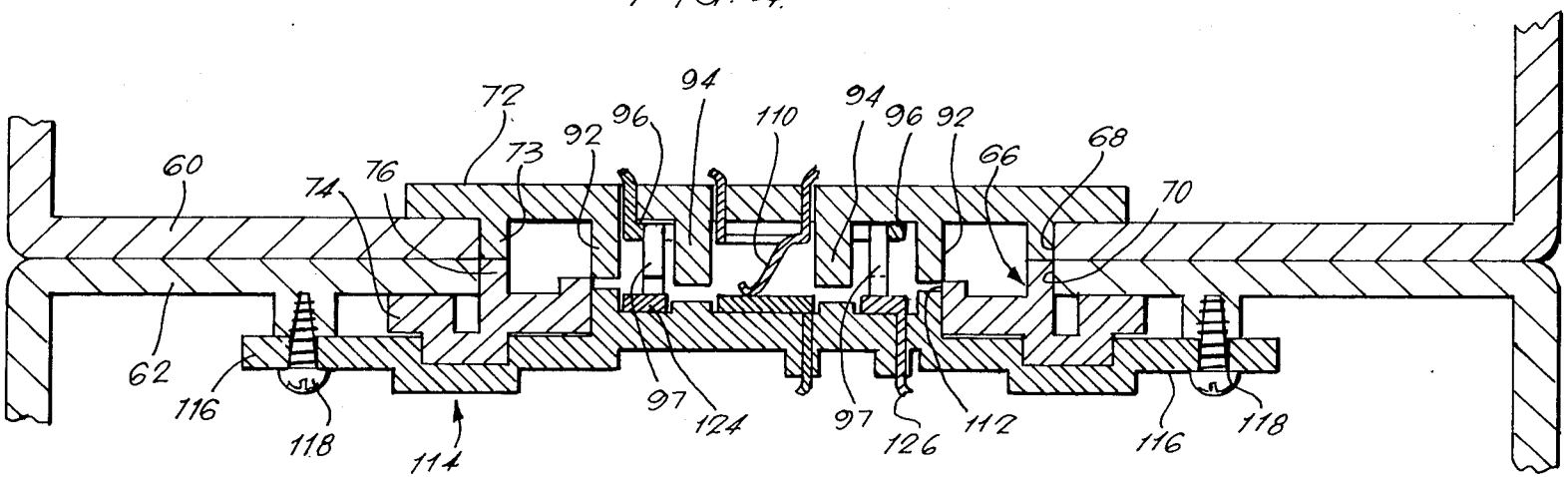
FIG. 4 is an enlarged section taken along the line 4—4 of FIG. 1.

Integrally formed with the inside-facing surface of the portion 72 are a pair of concentric circular flanges 92 and 94 (see FIG. 4). Between these two flanges is provided a conducting ring contact 96 of brass. The ring has a pair of downwardly projecting fingers 97 cut from the ring and bent outwardly from it. Integrally formed with that ring 96 are contact terminals 98, one of which is longer than the other and which passes out through the top of the portion 72 through slots 100. Within the inner flange 94 is provided a circular brass contact 102, and this has integral upstanding terminals 104 which pass out through the top of the portion 72 through slots 108. The contact has a downwardly depending finger 110.

The portion 74 has an open central opening 112 and the flanges 92 and 94 are exposed through this opening and project part-way into it. Over the portion 74 extends a contact carrier 114. This has diametrically projecting wings 116 which are attached to the face 62 by means of screws 118.

Centrally of the contact carrier are provided a pair of inwardly projecting circular flanges 120 and 122 which correspond in diameter to the flanges 92 and 94. Between this pair of flanges is provided a further brass contact ring 124 which has integral terminals 126. These extend out through slots 128 in the carrier 114. Within the central flange 122 is provided a circular brass contact 130 which again has integral outwardly formed terminals 132, one of which is longer than the other.

The brass contacts 96 and 102 are securely held within the portion 72 by bending over the ends of the terminals 98 and 104 where they project through the portion 72. This is shown most clearly in FIG. 3. In a similar fashion, the contacts 124 and 130 are securely held within the carrier 114 by bending over the projecting ends of the terminals 126 and 132. The fingers 97 and the finger 110 resiliently engage the contacts 124 and 130, respectively. This ensures good electrical contact irrespective of the orientation and swivelling of the segments relative one another.

Figure 2:
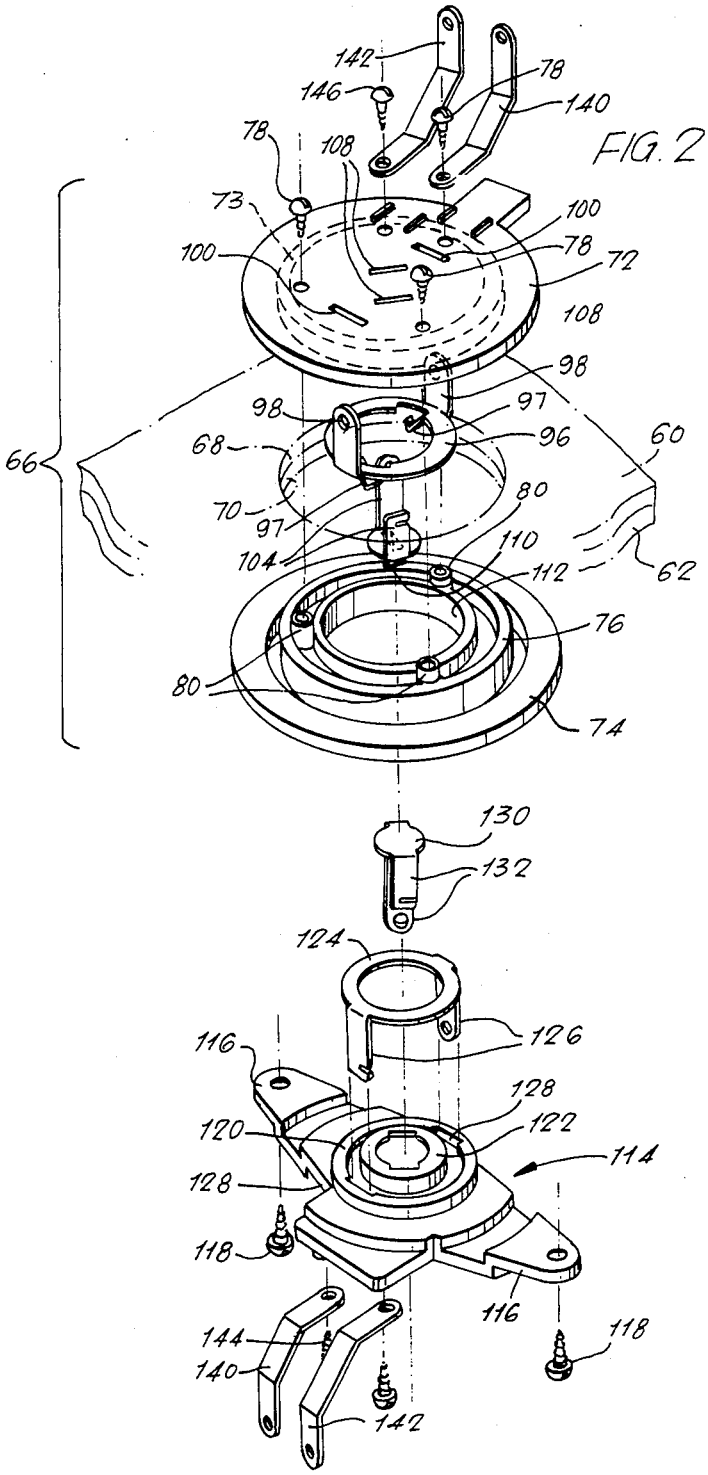
FIG. 2 is an exploded detail showing the bearing and commutator means between adjacent segments.

As best shown in FIGS. 2 and 3, in order to provide electrical continuity throughout the length of the arm 14, brass conductor strips 140 and 142 are provided in each segment. Thus, one of the terminals 98 is joined to one end of the strip 140 by one of the screws 78. In turn, the other end of that strip 140 is joined by a screw 144 to the bent-over end of the terminal 126. Also, the longer of the two terminals 104 is joined by a screw 146 threaded into the portion 72 to the contact strip 142 whilst the other end of the strip 142 is joined by a screw 148 threaded into the carrier 114 to the bent-over end of the longer of the terminals 132. In this way, electrical contact is achieved throughout the length of the arm between the switch 18 and transformer 20 at the lower end and the light bulb 16 at the upper end.

As will be appreciated, the lamp provides an unusual appearance and the ability to change the configuration of the arm to various interesting and unusual shape. Despite that, good illumination can be given. Also, because of the arrangement of the electrical contacts between adjacent segments, a good electrical path to the lamp is provided and there is no flex to become tangled or over-twisted. The arrangement is therefore electrically safe.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim

1. A table lamp comprising:

a base, an arm upstanding from said base and having an inner end joined to said base and an outer end, said arm being constituted by a number of hollow box-like segments, bearing means rotatably joining adjacent segments to one another so that adjacent segments are capable of rotation one relative the other, a lamp supported in the segment at said outer end of said arm, said lamp being arranged to provide illumination when energised, an electrical supply cord leading to said base, commutator means aligned with said bearing means between each adjacent pair of segments for passing electrical current from one segment to an adjacent segment, conductor means in each segment for passing electrical current from commutator means to commutator means, said lamp being connected to said commutator means from said segment at said outer end of said arm and said supply cord being connected to commutator means for a segment at said inner end of said arm.

2. A table lamp according to claim 1 in which each hollow box-like segment comprises a pair of opposed isosceles triangular shaped side faces, a pair of square shaped faces bounding the shorter sides of the triangle and a rectangular base bounding the longer side of the triangle, adjacent segments being joined to one another with said square shaped faces in face to face contact.

3. A table lamp according to claim 2 in which said triangular shaped faces have for the triangle an apex angle of 90° and equal angles of 45°, whereby said arm is upstanding from said base at an angle of 45°.

4. A table lamp according to claim 2 further comprising detent means for resiliently holding one segment relative an adjacent segment at a preferred orientation.

5. A table lamp according to claim 4 in which said detent means comprise a number of recesses in one square shaped face and a spring-loaded ball projecting from the mating square shaped face, said ball being resiliently urged into a recess in a preferred orientation.

6. A table lamp according to claim 1 in which said bearing means comprises a composite bush comprising a circular plate with a circular flange inwardly spaced from the edge of said plate, an annular ring with projecting circular flange of the same diameter as said circular flange inwardly spaced from the edge of said bush, means for joining said plate and ring together with said flanges in alignment, circular openings in mating faces of adjacent segments, said composite bush holding said mating faces together with said aligned flanges passing through the circular openings in said mating faces.

7. A table lamp according to claim 2 in which said bearing means comprises a composite bush comprising a circular plate with a circular flange inwardly spaced from the edge of said plate, an annular ring with projecting circular flange of the same diameter as said circular flange inwardly spaced from the edge of said bush, means for joining said plate and ring together with said flanges in alignment, circular openings in mating faces of adjacent segments, said composite bush holding said mating faces together with said aligned flanges passing through the circular openings in said mating faces.

8. A table lamp according to claim 6 further comprising inner and outer contact rings carried by said composite bush, a contact carrier fixed over said bush and inner and outer contact rings carried by said carrier, said pair of inner contact rings being in electrical contact with one another and said pair of outer contact rings being in electrical contact with one another but insulated from said pair of inner contact rings.

9. A table lamp according to claim 7 further comprising means to hold said composite bush stationary relative one of a pair of abutting segments and means being provided to attach said contact carrier to the other of said segments.

* * * * *